US008579421B2

(12) United States Patent
Ito et al.

(10) Patent No.: US 8,579,421 B2
(45) Date of Patent: Nov. 12, 2013

(54) LIQUID SUPPLYING APPARATUS, LIQUID EJECTING APPARATUS, AND LIQUID SUPPLYING METHOD

(75) Inventors: Koji Ito, Shiojiri (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 302 days.

(21) Appl. No.: 12/966,898

(22) Filed: Dec. 13, 2010

(65) Prior Publication Data

US 2011/0141208 A1 Jun. 16, 2011

(30) Foreign Application Priority Data

Dec. 15, 2009 (JP) ..... 2009-284555

(51) Int. Cl.
*B41J 2/175* (2006.01)
*B41J 2/17* (2006.01)

(52) U.S. Cl.
USPC ..... 347/85; 347/84; 347/86

(58) Field of Classification Search
USPC ..... 347/84, 85, 86
See application file for complete search history.

(56) References Cited

U.S. PATENT DOCUMENTS

2005/0151810 A1* 7/2005 Graham et al. ..... 347/86

FOREIGN PATENT DOCUMENTS

JP 2002-200766 A 7/2002

* cited by examiner

*Primary Examiner* — Jannelle M LeBron
(74) *Attorney, Agent, or Firm* — Kilpatrick Townsend & Stockton LLP

(57) ABSTRACT

A liquid supplying apparatus includes: a table on which a liquid container is placed, the liquid container containing liquid; a needle that can be inserted into the liquid container so as to supply the liquid contained in the liquid container to a liquid consumption side therethrough, the liquid consumption side being a side at which the liquid supplied through the needle is consumed; and a rotation mechanism that rotates the liquid container around one axis in process of the relative movement which is the movement of the table with respect to the needle.

10 Claims, 5 Drawing Sheets

LIQUID SUPPLYING APPARATUS, LIQUID EJECTING APPARATUS, AND LIQUID SUPPLYING METHOD

BACKGROUND

1. Technical Field

The present invention relates to a liquid supplying apparatus, a liquid ejecting apparatus, and a liquid supplying method.

2. Related Art

A liquid ejecting apparatus that ejects liquid (e.g., ink) onto a recording target medium (e.g., paper) to form a predetermined image (including characters, a figure, or the like) on the recording target medium is known in the art. A liquid supplying needle that is in communication with a liquid ejecting head is inserted into a liquid container, which contains liquid that is to be ejected. The liquid is supplied from the liquid container to the liquid ejecting head through the liquid supplying needle. The liquid ejecting apparatus ejects the liquid from the liquid ejecting head. To avoid the aged deterioration of an image, it is known that some liquid ejecting apparatuses of related art use liquid having excellent environment resistance (i.e., weatherability). Liquid that includes pigment as its solute is a popular example of such liquid having excellent environment resistance.

As is commonly known, since liquid that includes pigment is water-based dispersion liquid, the distribution of pigment particles in a solvent is generally poor. Because of poor pigment distribution, the pigment particles tend to precipitate in the liquid contained in a liquid container in the direction of gravitation force. For this reason, the density of liquid that is supplied to a liquid-ejecting-head side through a liquid supplying needle could lack uniformity depending on the distribution density of pigment particles. Consequently, an image formed with the use of such liquid will be poor due to shading irregularities or the like, which will be caused by a difference in the liquid density.

To provide a solution to the above problem that arises when liquid that includes pigment is used, the following technique is disclosed in, for example, JP-A-2002-200766. A liquid container such as an ink pack, which contains liquid, has a cylindrical shape. The liquid container is periodically rotated around the axis of its cylindrical body by an angle of rotation of 180 degrees. By this means, the liquid including pigment is stirred in the liquid container. The technique disclosed in JP-A-2002-200766 reduces the difference in the liquid density in this way.

In many cases, liquid containers are mass-produced at the same time to increase production efficiency. Therefore, liquid containers are sometimes stored for a long period in a warehouse or the like. During the storage of a liquid container for a long period, there occurs a large concentration gradient, that is, a large gradient of density, of pigment particles from the bottom of the liquid container, toward which the pigment particles of the liquid are gravitated, to the top of the liquid container.

In the technique disclosed in JP-A-2002-200766, a liquid container is periodically rotated around the axis of its cylindrical body by an angle of rotation of 180 degrees after the attachment of the liquid container to a liquid ejecting apparatus and the insertion of a liquid supplying needle into the liquid container. That is, even when the liquid container is in a needle-inserted state after the attachment thereof to the liquid ejecting apparatus, the liquid contained in the liquid container has not been stirred yet before the programmed periodic rotation thereof starts.

For this reason, when attaching a liquid container stored for a long period to a liquid ejecting apparatus, a user must stir the liquid contained in the liquid container by shaking it or by any other means before the attachment of the liquid container to the liquid ejecting apparatus. If the user forgets to shake the liquid container beforehand, there is a possibility that an image that is formed as a result of ejection of the liquid supplied from the liquid container immediately after the attachment may be poor due to shading irregularities or the like.

SUMMARY

An advantage of some aspects of the invention is to provide a liquid supplying apparatus and a liquid supplying method that ensures that, when an old liquid container is detached for replacement with a new liquid container, the liquid contained in the new liquid container is stirred at the time of needle-insertion attachment; thus, it is possible to supply the well-stirred liquid to a liquid ejecting mechanism or the like through the needle after the completion of the attachment. Another advantage of some aspects of the invention is to provide a liquid ejecting apparatus that can eject the liquid supplied from the liquid supplying apparatus with a reduction in density irregularities.

A liquid supplying apparatus according to a first aspect of the invention includes a table, a needle, and a rotation mechanism. A liquid container containing liquid is placed on the table. The needle can be inserted into the liquid container so as to supply the liquid contained in the liquid container to a liquid consumption side therethrough. The liquid consumption side is a side at which the liquid supplied through the needle is consumed. The rotation mechanism rotates the liquid container around one axis. The needle can be inserted into the liquid container placed on the table as a result of relative movement, which is the movement of the table with respect to the needle, the movement of the needle with respect to the table, or the movement of both the table and the needle with respect to each other. The rotation mechanism rotates the liquid container around the one axis in the process of the relative movement.

In such a structure, the liquid container is rotated as a result of the relative movement of the table and the needle in a state in which the liquid container is placed on the table. Therefore, when an old liquid container is detached for replacement with a new liquid container, it is ensured that the liquid contained in the new liquid container is stirred at the time of needle-insertion attachment. Thus, it is possible to supply the well-stirred liquid to a liquid ejecting mechanism or the like through the needle after the completion of the attachment.

In a liquid supplying apparatus according to the first aspect of the invention, it is preferable that the rotation mechanism should rotate the liquid container around the one axis at least once during a period of time from the placement of the liquid container on the table to the insertion of the needle into the liquid container. With such a preferred structure, since the liquid container is rotated at least once, even in a case where it has been stored for a long period, it is possible to stir the liquid contained in the liquid container well. For this reason, it is not necessary for a user to shake the liquid container for stirring before attachment to a liquid ejecting apparatus.

In a liquid supplying apparatus according to the first aspect of the invention, it is preferable that the rotation mechanism should include an engagement portion that can move relative to the liquid container placed on the table in a direction along the one axis; the engagement portion should be in engagement with a cam portion in the process of the movement thereof relative to the liquid container; the cam portion should be formed in or on an outer surface of the liquid container; and the cam portion should have a spiral shape around the one axis. With such a preferred structure, it is possible to rotate the liquid container placed on the table with high reliability by moving the engagement portion relative to the liquid container while keeping the engagement portion, which is a component of the rotation mechanism, with the spiral cam portion formed in or on the outer surface of the liquid container.

In a liquid supplying apparatus having such a preferred structure, the rotation mechanism may stop the rotation of the liquid container due to disengagement of the engagement portion from the cam portion of the liquid container before the insertion of the needle into the liquid container. With the above structure, at the time of the insertion of the needle into the liquid container, the exertion of stress to the needle or to the liquid container in any direction other than the direction of insertion can be suppressed. The suppression of such undesirable stress improves liquid-tight reliability. For example, it has an effect of preventing the leakage of liquid from a contact region between the needle and the liquid container.

In a liquid supplying apparatus according to the first aspect of the invention, it is preferable that the rotation mechanism should include a linear gear that extends in the direction of the relative movement of the table and the needle, a spur gear that is in meshing engagement with the linear gear in the process of the relative movement of the table and the needle, and a driving gear that is interlocked with the spur gear by a rotating shaft and is provided over the table in such a manner that the driving gear can be in meshing engagement with a driven gear provided on the liquid container; and the driven gear should rotate around the one axis. With such a preferred structure, when, for example, the table is moved toward the needle to cause relative displacement in a state in which the spur gear is in meshing engagement with the linear gear, the driving gear rotates together with the spur gear. Since the driving gear rotates, the driven gear, which is in meshing engagement with the driving gear, rotates. By this means, it is possible to rotate the liquid container placed on the table with high reliability.

In a liquid supplying apparatus having such a preferred structure, the rotation mechanism may stop the rotation of the liquid container due to disengagement of the spur gear from the linear gear before the insertion of the needle into the liquid container. With the above structure, at the time of the insertion of the needle into the liquid container, the exertion of stress to the needle or to the liquid container in any direction other than the direction of insertion can be suppressed. The suppression of such undesirable stress improves liquid-tight reliability. For example, it has an effect of preventing the leakage of liquid from a contact region between the needle and the liquid container.

In a liquid supplying apparatus according to the first aspect of the invention, it is preferable that the liquid container should include a plurality of liquid containers placed on the table; at least one of the plurality of liquid containers should contain a second liquid that has greater precipitation property than that of a first liquid; and the rotation mechanism should rotate each of the plurality of liquid containers in such a manner that the number of rotations of the at least one liquid container containing the second liquid is larger than the number of rotations of the others, the other, others, or another liquid container containing the first liquid.

With such a preferred structure, when a plurality of liquid containers is attached, a liquid container that contains liquid that includes, for example, pigment particles as its solute and thus has greater precipitation property is rotated by a number of rotations that is larger than that of (the) other liquid container(s). Thus, it is possible to stir the liquid having greater precipitation property reliably as can be done for the other liquid containers.

In a liquid supplying apparatus according to the first aspect of the invention, it is preferable that the liquid container should have a cylindrical shape; and the one axis should be an axis along the direction of the cylindrical axis of the liquid container. With such a preferred structure, a space that is required for the rotation of the liquid container can be minimized, which contributes to the space-saving design of the liquid supplying apparatus. In the above structure, if the liquid container is placed on the table in such a manner that the axis of its cylindrical body is oriented in a direction that is orthogonal to the direction of gravitational force, it is possible to agitate pigment particles that have precipitated in the liquid contained therein, that is, stir the liquid, reliably.

A liquid ejecting apparatus according to a second aspect of the invention includes: a liquid ejecting head that consumes liquid when performing liquid ejecting operation, and a liquid supplying apparatus according to the first aspect of the invention. Since well-stirred liquid is supplied to the liquid ejecting head, the liquid ejecting apparatus can eject the liquid with a reduction in density irregularities.

A liquid supplying method according to a third aspect of the invention includes: moving, for relative movement, a table with respect to a needle, the needle with respect to the table, or both the table and the needle with respect to each other, a liquid container that contains liquid being placed on the table, the needle being able to be inserted into the liquid container so as to supply the liquid contained in the liquid container to a liquid consumption side therethrough, the liquid consumption side being a side at which the liquid supplied through the needle is consumed, and rotating the liquid container around one axis in the process of the relative movement by bringing a rotation mechanism into engagement with the liquid container. The liquid supplying method can produce the same effects as those of the liquid supplying apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
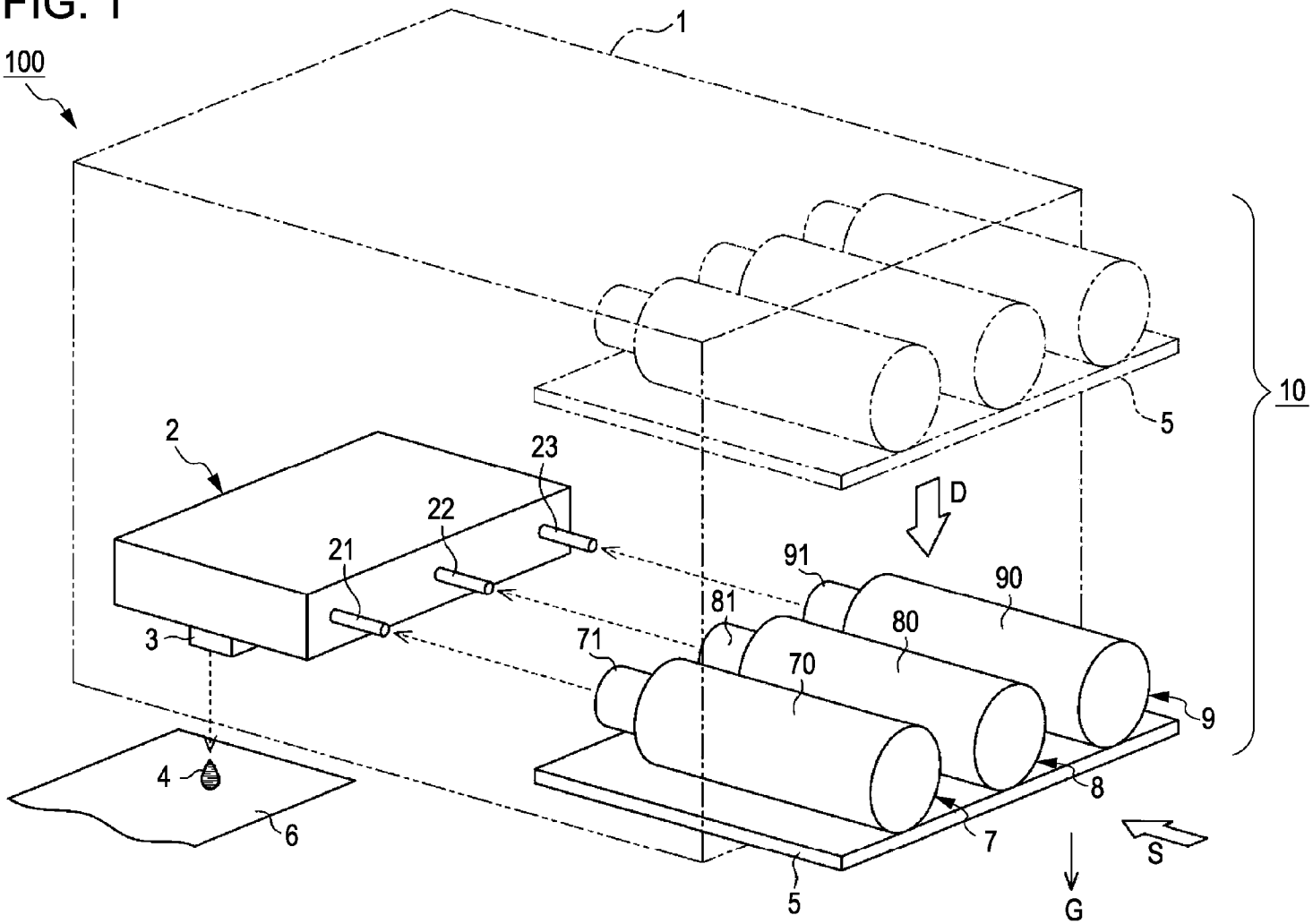
FIG. 1 is a perspective view that schematically illustrates an example of the configuration of a liquid ejecting apparatus including a liquid supplying apparatus according to a first embodiment of the invention.

With reference to the accompanying drawings, a first embodiment of the present invention will now be explained in detail. As illustrated in FIG. 1, a liquid ejecting apparatus 100 includes a liquid ejecting mechanism 2 and a liquid supplying apparatus 10 that are provided in an apparatus body 1 having the shape of a box. The liquid ejecting mechanism 2 is a mechanical component that consumes liquid such as ink. The liquid supplying apparatus 10 is a mechanical component that supplies liquid to the liquid ejecting mechanism 2. The liquid ejecting mechanism 2 is provided with needles for supplying liquid (hereinafter referred to as "supply needles") 21, 22, and 23 and a liquid ejecting head (hereinafter referred to as "ejection head") 3. Each of the supply needles 21, 22, and 23 functions as an inlet through which liquid is supplied into the liquid ejecting mechanism 2. The ejection head 3 ejects the supplied liquid toward an ejection target medium 6 in the form of droplets 4 for recording. Each of the supply needles 21, 22, and 23 has the shape of a hollow pipe. Examples of its material are metal or resin. Liquid is supplied through the hollow pipe into the liquid ejecting mechanism 2. A means for ejecting liquid, which is not illustrated in the drawing, is provided inside the ejection head 3. Electrostrictive elements or heating elements are used as the liquid ejecting means. Having such a means, the ejection head 3 discharges the liquid droplets 4 in accordance with an image that is formed on the target 6.

The liquid supplying apparatus 10 includes a container table 5 on which a plurality of liquid containers 7, 8, and 9 is placed and a slide mechanism that is not illustrated in the drawing. Liquid (pigment ink in the present embodiment) is contained in the liquid container 7, 8, 9. The slide mechanism enables the container table 5 to be reciprocated in an S direction and a D direction. The S direction is a direction in which the container table 5 comes closer to and away from the supply needles 21, 22, and 23. The D direction is orthogonal to the S direction (vertical direction in FIG. 1). The container table 5 is moved in the D direction to the position shown by a solid line in FIG. 1 by means of the slide mechanism. Thereafter, the container table 5 is moved in the S direction by means of the slide mechanism in such a way as to approach the supply needles 21, 22, and 23. As a result, the supply needles 21, 22, and 23 are respectively inserted into the liquid containers 7, 8, and 9 placed on the container table 5. In such a need-inserted state, liquid is supplied to the liquid ejecting mechanism 2. A well-known mechanism can be used as the slide mechanism. For example, the slide mechanism includes an S-direction guiding member, which is fixed inside the apparatus body 1 to extend in the S direction, a D-direction guiding member, which is fixed inside the apparatus body 1 to extend in the D direction, a slider that moves while being guided by these guiding members, for example, the container table 5, and the like. The container table 5 can be moved manually or automatically.

Each of the liquid containers 7, 8, and 9 has a cylindrical shape. The liquid containers 7, 8, and 9 have body portions 70, 80, and 90 and bottleneck portions 71, 81, and 91, respectively. The body portions 70, 80, and 90 contain liquid. Flow channels through which the liquid flows from the inside of the body portions 70, 80, and 90 to the outside are formed in the bottleneck portions 71, 81, and 91, respectively. Driven-side gears 72, 82, and 92 (refer to FIG. 2) are provided at the tips of the bottleneck portions 71, 81, and 91, respectively. Each of the driven-side gears 72, 82, and 92 is a bevel gear that is made of a resin material or a metal material. The driven-side gears 72, 82, and 92 rotate together with the liquid containers 7, 8, and 9, respectively.

Figure 2A:
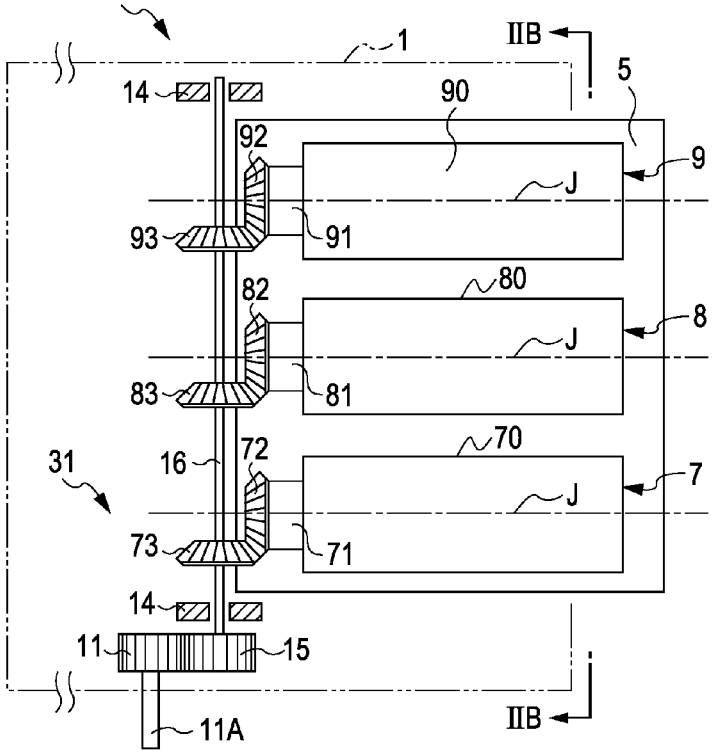
FIG. 2A is a plan view that schematically illustrates an example of the configuration of a first rotation mechanism provided in the liquid supplying apparatus.
Figure 3:
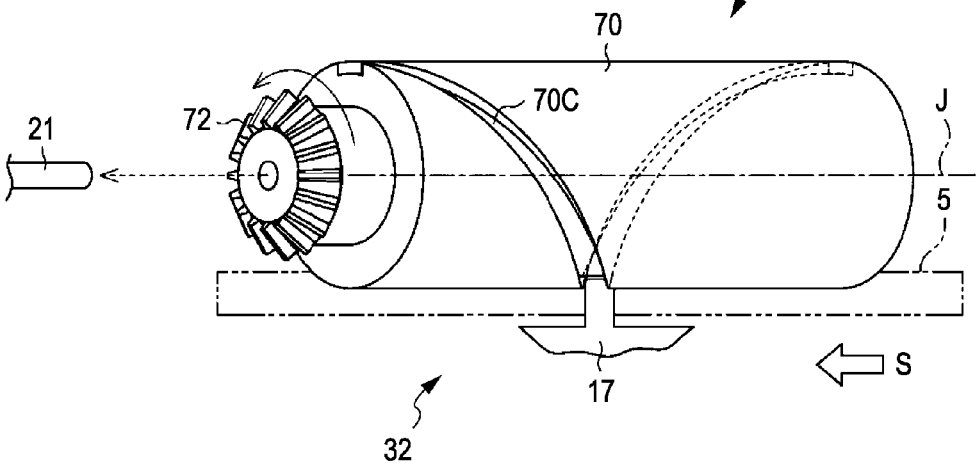
FIG. 3 is a perspective view that schematically illustrates an example of the configuration of a second rotation mechanism provided in the liquid supplying apparatus.

As illustrated in FIGS. 2A and 3, the liquid supplying apparatus 10 according to the present embodiment of the invention includes a rotation mechanism (a first rotation mechanism 31 and a second rotation mechanism 32 that will be explained later) that rotates the liquid containers 7, 8, and 9 placed on the container table 5. Specifically, each of the liquid containers 7, 8, and 9 is placed on the container table 5 in such a manner that the axis of its cylindrical body is oriented in a direction (shown as S direction in FIG. 1) that is orthogonal to the direction of gravitational force (shown as G direction in FIG. 1). In order to stir (i.e., agitate) liquid in which pigment particles have precipitated inside the body portions 70, 80, and 90 of the liquid containers 7, 8, and 9 in the direction of, for example, gravitational force, the rotation mechanism is configured to rotate each of the liquid containers 7, 8, and 9 around one axis J, where the axis J goes in the direction of the cylindrical axis of the liquid container 7, 8, 9 (including but not limited to an axis that is the same as the cylindrical axis).

Figure 2B:
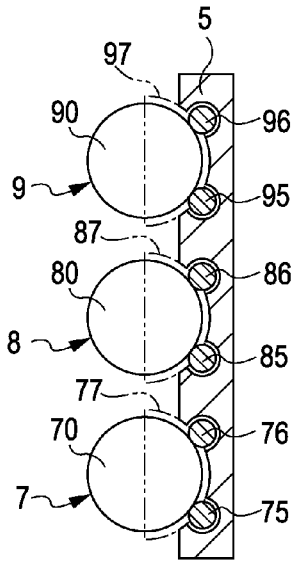
FIG. 2B is a sectional view taken along the line IIB-IIB of FIG. 2A.

As illustrated in FIG. 2B, rollers 75, 76, 85, 86, 95, and 96 that support the liquid containers 7, 8, and 9 rotatably are provided in the container table 5 so that each of the liquid containers 7, 8, and 9 can rotate around the axis J smoothly. FIG. 2B is a partial cross-sectional view taken along the line IIB-IIB in FIG. 2A to show a section of the container table 5. As shown by a two-dot chain line in FIG. 2B, body-holding members 77, 87, and 97 each of which has the shape of a semicylinder that is half-rounded along the surface of the corresponding body portion 70, 80, 90 may be provided in addition to the rollers 75, 76, 85, 86, 95, and 96. With such a structure, it is possible to hold the liquid containers 7, 8, and 9 with increased stability.

As the rotation mechanism mentioned earlier, the liquid supplying apparatus 10 is equipped with two mechanisms that drive the liquid containers 7, 8, and 9 for rotation in modes that are different from each other, that is, the first rotation mechanism 31 and the second rotation mechanism 32. During a period of time from the placement of the liquid containers 7, 8, and 9 on the container table 5 to the insertion of the supply needles 21, 22, and 23 into the liquid containers 7, 8, and 9, respectively, the first rotation mechanism 31 rotates the liquid containers 7, 8, and 9 around the axis J when the container table 5 is set at the upper position shown by the two-dot chain line in FIG. 1. On the other hand, the second rotation mechanism 32 rotates the liquid containers 7, 8, and 9 in the process of the movement of the container table 5 (the liquid containers 7, 8, and 9) toward the supply needles 21, 22, and 23 in the S direction after the movement of the container table 5 in the D direction from the upper position to the lower position shown by the solid line in FIG. 1. As described briefly above, the rotation mechanism rotates the liquid containers 7, 8, and 9 in the two rotation drive modes that are different from each other.

The structure and operation of the rotation mechanism according to the present embodiment of the invention will now be explained. The first rotation mechanism 31 is explained first, followed by an explanation of the second rotation mechanism 32.

As illustrated in FIG. 2, the first rotation mechanism 31 includes a linear gear (rack) 11, a spur gear (pinion) 15, and driving-side gears 73, 83, and 93 as its main components. The linear gear 11 extends vertically (in a direction perpendicular to the sheet face of FIG. 2A) inside the apparatus body 1 and can be moved freely in the vertical direction. The spur gear 15 is in meshing engagement with the linear gear 11. Each of the driving-side gears 73, 83, and 93 is a bevel gear that rotates together with the spur gear 15. A lever 11A is fixed to a part of the linear gear 11. The lever 11A protrudes to the outside of the apparatus body 1. The spur gear 15 and the driving-side gears 73, 83, and 93 are fixed to a rotating shaft 16. A pair of shaft-supporting parts 14 that is formed on the apparatus body 1 rotatably supports both ends of the rotating shaft 16. When the container table 5 is set at the upper position shown by the two-dot chain line in FIG. 1, each of the driving-side gears 73, 83, and 93 is in meshing engagement with the corresponding one of the driven-side gears 72, 82, and 92, which are provided respectively on the bottleneck portions 71, 81, and 91 of the liquid containers 7, 8, and 9 as driven bevel gears.

Next, the rotation of the liquid containers 7, 8, and 9 by the first rotation mechanism 31 having the above structure is explained below. A user of the liquid ejecting apparatus 100 can rotate the liquid containers 7, 8, and 9 by moving the lever 11A in the direction of a row of teeth of the linear gear 11 (that is, by moving the lever 11A up or down). Specifically, when the user moves the lever 11A in the back-to-front direction in FIG. 2A, that is, from the back of the sheet to the front thereof (or in the front-to-back direction), the linear gear 11 runs in the row-of-teeth direction. As a result, the spur gear 15, which is in meshing engagement with the linear gear 11 and becomes displaced relative thereto, rotates. Since the spur gear 15 rotates, the driving-side gears 73, 83, and 93 fixed to the rotating shaft 16 rotate concurrently by an angle of rotation equal to that of the spur gear 15. Since the driving-side gears 73, 83, and 93 are in meshing engagement with the driven-side gears 72, 82, and 92 provided on the liquid containers 7, 8, and 9, respectively, the driven-side gears 72, 82, and 92 rotate by a predetermined number of rotations that depends on the number of rotations of the driving-side gears 73, 83, and 93. Consequently, each of the liquid containers 7, 8, and 9 is rotated around the axis J along the direction of the cylindrical axis of the liquid container 7, 8, 9 by the predetermined number of rotations.

If the lever 11A is moved up and down, that is, reciprocated, the liquid containers 7, 8, and 9 rotate in the normal direction and the reverse direction. That is, the liquid containers 7, 8, and 9 rotate in the normal and reverse directions when the lever 11A is operated vertically in a reciprocating manner. When the speed of the movement of the lever 11A is increased, the speed of the rotation of the liquid containers 7, 8, and 9 also increases. When the speed of the movement of the lever 11A is decreased, the speed of the rotation of the liquid containers 7, 8, and 9 also decreases.

The liquid contained in the liquid container 8 includes pigment particles as its solute. The solute of the liquid contained in the liquid container 8 has a greater tendency to precipitate than that of the liquid contained in the liquid containers 7 and 9. For this reason, the first rotation mechanism 31 is configured to rotate the liquid container 8 by a predetermined number of rotations that is larger than that of the liquid containers 7 and 9. Specifically, though not illustrated in the drawings, the gear ratio for the liquid container 8, which can be calculated by dividing the number of the teeth of the driving-side gear 83 by the number of the teeth of the driven-side gear 82, is larger than the other gear ratios (e.g., the gear ratio for the liquid container 7, which can be calculated by dividing the number of the teeth of the driving-side gear 73 by the number of the teeth of the driven-side gear 72). Because of such a structure, since the number of rotations of the liquid container 8 is larger than that of the liquid containers 7 and 9, the liquid contained in the liquid container 8 is stirred with a greater degree of agitation as compared with the liquid contained in the liquid containers 7 and 9.

Next, with reference to FIG. 3, the second rotation mechanism 32 will now be explained. In the structure of the liquid supplying apparatus 10 according to the present embodiment of the invention, the meshing of the driving-side gears 73, 83, and 93 with the driven-side gears 72, 82, and 92 becomes disengaged when the container table 5 is moved in the D direction. The disengagement makes it possible for the container table 5 to be moved toward the supply needles 21, 22, and 23 (in the S direction). Therefore, the container table 5 is configured to be able to move toward the supply needles 21, 22, and 23 in the S direction after its movement in the D direction. The second rotation mechanism 32 is configured to rotate the liquid containers 7, 8, and 9 in the process of the movement of the container table 5 in the S direction.

As illustrated in FIG. 3, the second rotation mechanism 32 includes a cam portion 70C that is formed in the outer surface of the cylindrical body portion 70 of the liquid container 7 in a spiral form around the cylindrical axis and further includes an engagement portion 17 that can be brought into engagement with the cam portion 70. That is, the second rotation mechanism 32 is a so-called drum cam (i.e., cylindrical cam). The engagement portion 17 is fixed to the apparatus body 1 at a distance from the supply needle 21. The engagement portion 17 disposed thereat can become displaced relative to the container table 5 along the direction of the cylindrical axis, which is the direction of one axis (i.e., in the S direction).

In the present embodiment of the invention, the cam portion 70C is formed in the outer surface of the body portion 70 of the liquid container 7 as a spiral concave that is deep enough so that the engagement portion 17 can be brought into, and be kept in, engagement therewith in a stable manner. In order to ensure that each of the liquid containers 7, 8, and 9 can be rotated at least once, the number of turns of the spiral of the cam portion 70C as viewed in the direction of the cylindrical axis (i.e., in the S direction) (hereinafter may be referred to as "the number of spiral turns") is designed as a predetermined number of turns (which is at least one turn). Both ends of the cam portion 70C in the S direction are formed as open ends. Because of such a structure, the engagement portion 17 can pass through the body portion 70 in the S direction while being in engagement with the cam portion 70C formed in the outer surface of the body portion 70.

Figure 4A:
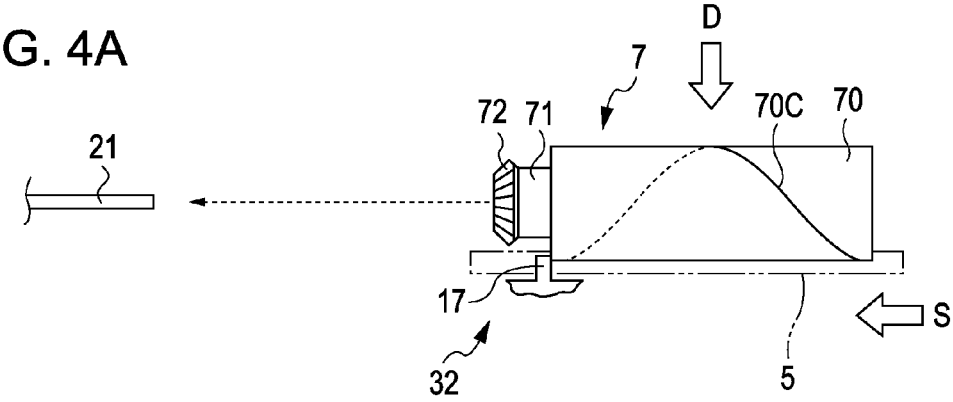
FIG. 4A is a diagram that schematically illustrates an example of a process of the insertion of a supply needle into a liquid container in the first embodiment of the invention.
Figure 4B:
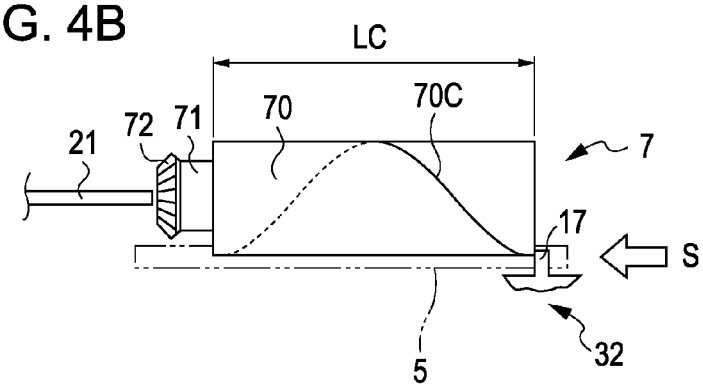
FIG. 4B is a diagram that schematically illustrates an example of a process of the insertion of the supply needle into the liquid container in the first embodiment of the invention.
Figure 4C:
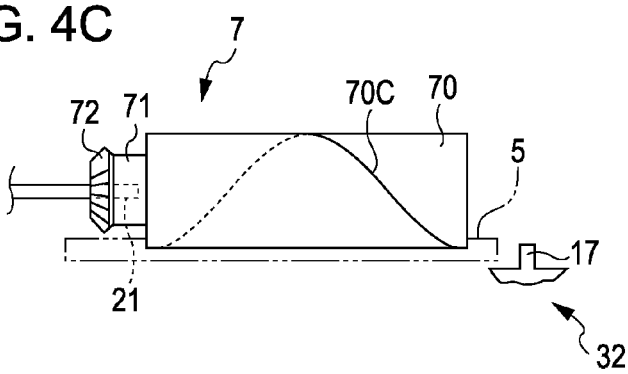
FIG. 4C is a diagram that schematically illustrates an example of a process of the insertion of the supply needle into the liquid container in the first embodiment of the invention.

Next, with reference to FIG. 4, the rotation of the liquid containers 7, 8, and 9 by the second rotation mechanism 32 having the above structure is explained below. FIG. 4A schematically illustrates a state in which the engagement of the engagement portion 17 with the cam portion 70C starts. FIG. 4B schematically illustrates a state in which the engagement of the engagement portion 17 with the cam portion 70C ends, which means that they have now become disengaged from each other. FIG. 4C schematically illustrates a state in which the insertion of the supply needle 21 into the liquid container 7 has now been completed. In FIG. 4, the movement and rotation of the liquid container 7 is shown by way of illustration. It goes without saying that the movement and rotation of the liquid containers 8 and 9 is performed in the same manner as in the illustrated example. To simplify illustration, the cam portion 70C is shown in FIG. 4 as a single spiral curve.

As illustrated in FIG. 4A, after the rotation of the liquid containers 7, 8, and 9 by the first rotation mechanism 31, that is, after the completion of the movement of the lever 11A, the container table 5 is moved in the D direction (toward the bottom of the sheet in FIG. 4) by means of the slide mechanism. As described earlier while referring to FIG. 2, a bevel gear is used for each of the driving-side gears 73, 83, and 93 and the driven-side gears 72, 82, and 92. Therefore, the meshing of the driving-side gears 73, 83, and 93 with the driven-side gears 72, 82, and 92 becomes disengaged easily when the container table 5 is moved in the D direction. Then, the engagement of the engagement portion 17 with the cam portion 70C starts either at a point in time when the movement of the container table 5 toward the supply needle 21 in the S direction starts or in the process of the movement of the container table 5 toward the supply needle 21 in the S direction. The rotation of the liquid container 7 does not occur before the start of the engagement of the engagement portion 17 with the cam portion 70C.

After the start of the rotation of the liquid container 7, as illustrated in FIG. 4B, as the container table 5 is moved in the S direction, the rotation of the liquid container 7 continues until the engagement portion 17 becomes disengaged from the cam portion 70C, that is, throughout a movement distance corresponding to the length LC of the body portion 70 in the S direction. As suggested earlier, the number of rotations of the liquid container 7 is determined on the basis of the number of spiral turns of the cam portion 70C that are formed throughout the length LC of the body portion 70. Therefore, the liquid supplying apparatus 10 has a structure in which the number of rotations of the liquid container 7 can be adjusted in accordance with the predetermined number of spiral turns of the cam portion 70C. In the present embodiment of the invention, it is assumed that the liquid contained in the liquid container 7 includes pigment particles as its solute. The solute of the liquid contained in the liquid container 7 has a greater tendency to precipitate than that of the liquid contained in the liquid containers 8 and 9. For this reason, the second rotation mechanism 32 is configured to rotate the liquid container 7 by a predetermined number of rotations that is larger than that of the liquid containers 8 and 9. Specifically, the number of spiral turns of the cam portion 70C formed in the outer surface of the body portion 70 of the liquid container 7 is larger than the number of spiral turns of a cam portion (not shown) formed in the outer surface of each of the body portions 80 and 90 of the liquid containers 8 and 9.

The direction of rotation of the liquid container 7 around the axis J is determined on the basis of the direction of turning of the spiral. In the present embodiment of the invention, the cam portion 70C is formed in such a spiral direction that the second rotation mechanism 32 rotates the liquid container 7 in the direction opposite to the direction of the rotation thereof by the first rotation mechanism 31.

As described above, in the present embodiment of the invention, the number of spiral turns of the cam portion and the direction of turning of the spiral is predetermined to ensure that the second rotation mechanism 32 rotates each of the liquid containers 7, 8, and 9 by a predetermined number of rotations and in a predetermined direction of rotation. Therefore, in a state in which the liquid containers 7, 8, and 9 are placed on the container table 5, the second rotation mechanism 32 rotates each of the liquid containers 7, 8, and 9 in a rotation drive mode (i.e., manner of driving) that is different from that of the first rotation mechanism 31.

As illustrated in FIG. 4C, after the completion of the rotation of the liquid container 7 due to the disengagement of the engagement portion 17 from the cam portion 70C, the container table 5 is moved farther in the S direction, resulting in the insertion of the supply needle 21 into the liquid container 7. In such a need-inserted state, the liquid supplying apparatus 10 according to the present embodiment of the invention is configured to supply the liquid contained in the liquid container 7 to the liquid ejecting mechanism 2. As a pre-step before the insertion of the supply needle 21 into the liquid container 7, the rotation of the liquid container 7 is stopped. By this means, it is ensured that the liquid container 7 stays still during a period of time from the start of the insertion of the supply needle 21 into the liquid container 7 to the end of the insertion of the supply needle 21 into the liquid container 7. The same holds true for the liquid containers 8 and 9.

The first embodiment of the invention explained above can produce the following advantageous effects.

(1) When the container table 5 is moved toward the supply needles 21, 22, and 23 to cause relative displacement in a state in which the liquid containers 7, 8, and 9 are placed on the container table 5, the liquid containers 7, 8, and 9 are rotated. Therefore, when an old liquid container is detached for replacement with a new liquid container, it is ensured that the liquid contained in the new liquid container is stirred at the time of needle-insertion attachment. Thus, it is possible to supply the well-stirred liquid to the liquid ejecting mechanism 2 through the supply needles 21, 22, and 23 after the completion of the attachment.

(2) Each of the liquid containers 7, 8, and 9 is rotated around the one axis J at least once (i.e., by 360 degrees). Therefore, even in a case where a liquid container stored for a long period is used, it is possible to stir the liquid contained in the liquid container well. For this reason, it is not necessary for a user to shake the liquid container for stirring before attachment to a liquid ejecting apparatus.

(3) It is possible to rotate the liquid container 7 by moving it toward the supply needle 21 to cause relative displacement while keeping the engagement portion 17 fixed to the apparatus body 1 in engagement with the spiral cam portion 70C formed in the outer surface of the body portion 70 thereof. Therefore, the liquid container 7 placed on the container table 5 rotates with high reliability.

(4) As a pre-step before the insertion of the supply needle 21 into the liquid container 7, the rotation of the liquid container 7 is stopped due to the disengagement of the engagement portion 17 from the cam portion 70C thereof. Therefore, at the time of the insertion of the supply needles 21, 22, and 23 into the liquid containers 7, 8, and 9, respectively, the exertion of stress to the supply needles 21, 22, and 23 or to the liquid containers 7, 8, and 9 in any direction other than the direction of insertion can be suppressed. The suppression of such undesirable stress improves liquid-tight reliability. For example, it has an effect of preventing the leakage of liquid from a contact region between the supply needle 21, 22, 23 and the liquid container 7, 8, 9.

(5) The number of rotations of the liquid container 8, which is a container that contains liquid having greater precipitation characteristics, is larger than that of the liquid containers 7 and 9. Therefore, even in a case where a liquid container that contains liquid that includes, for example, pigment particles as its solute and thus has greater precipitation property is attached, such a liquid container is rotated by a number of rotations that is larger than that of (the) other liquid container (s). Thus, it is possible to stir the liquid contained in the liquid container reliably as can be done for the other liquid containers.

(6) Each of the liquid containers 7, 8, and 9 has a cylindrical shape. Each of the liquid containers 7, 8, and 9 is rotated around the axis J along the direction of the cylindrical axis of the liquid container 7, 8, 9. With such a structure, a space that is required for the rotation of the liquid container 7, 8, 9 can be minimized, which contributes to the space-saving design of the liquid supplying apparatus 10. In the above structure, if each of the liquid containers 7, 8, and 9 is placed on the container table 5 in such a manner that the axis of its cylindrical body is oriented in a direction that is orthogonal to the direction of gravitational force, it is possible to agitate pigment particles that have precipitated in the liquid contained therein, that is, stir the liquid, reliably.

(7) Since the liquid containers 7, 8, and 9 can be rotated by a predetermined number of rotations (e.g., once or three times) in accordance with the distance of the movement of the lever 11A, it is possible to stir the liquid contained therein well.

Second Embodiment

Figure 5:
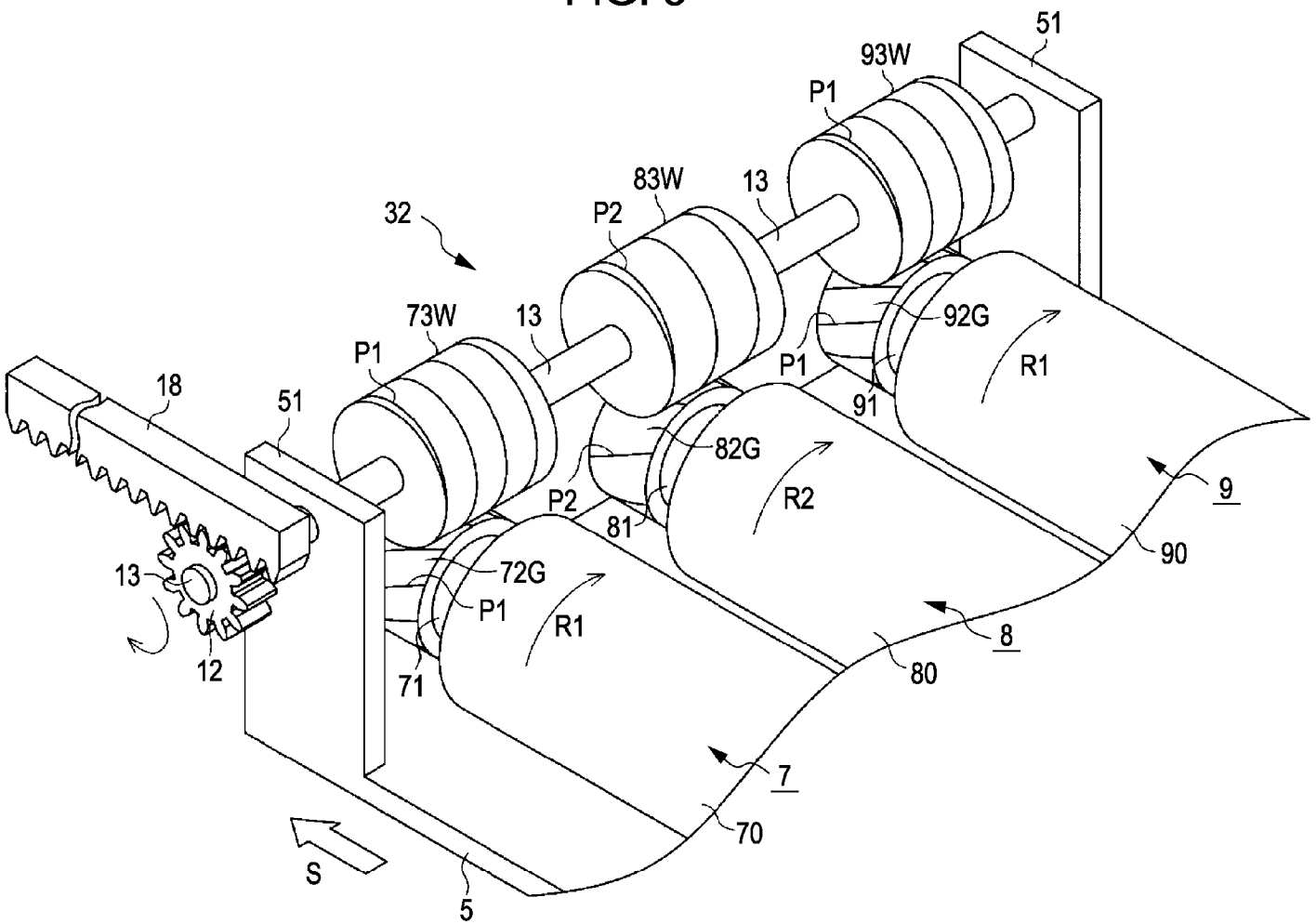
FIG. 5 is a perspective view that schematically illustrates an example of the configuration of a second rotation mechanism provided in a liquid supplying apparatus according to a second embodiment of the invention.

Next, a second embodiment of the invention will now be explained. The present embodiment of the invention discloses a modification example of the rotation mechanism according to the first embodiment of the invention. In particular, the rotation drive mode of the second rotation mechanism 32 according to the present embodiment of the invention is different from the rotation drive mode of the second rotation mechanism 32 according to the first embodiment of the invention. With reference to FIGS. 5 and 6, the present embodiment of the invention is explained below.

As illustrated in FIG. 5, the second rotation mechanism 32 according to the present embodiment of the invention includes a linear gear 18, a spur gear 12 that meshes with the linear gear 18, and worms 73W, 83W, and 93W that function as driving-side gears. The linear gear 18 is fixed to the apparatus body 1. Therefore, the linear gear 18 does not move relative to the supply needles 21, 22, and 23 (refer to FIG. 1). The spur gear 12 and the worms 73W, 83W, and 93W are fixed to a rotating shaft 13. A pair of shaft-supporting parts 51 that is formed on the container table 5 rotatably supports both ends of the rotating shaft 13. Driven-side gears (hereinafter referred to as "gears") 72G, 82G, and 92G are provided on the liquid containers 7, 8, and 9, respectively. Each of the worms 73W, 83W, and 93W is in meshing engagement with the corresponding one of the gears 72G, 82G, and 92G. In the present embodiment of the invention, the outside diameter of the worms 73W, 83W, and 93W is the same. In addition, the outside diameter of the gears 72G, 82G, and 92G is the same.

Next, how the rotation mechanism having the above structure rotates the liquid containers 7, 8, and 9 placed on the container table 5 will now be explained. When the spur gear 12 is moved while being in meshing engagement with the linear gear 18 to cause relative displacement, the spur gear 12 rotates. Since the spur gear 12 rotates, the worms 73W, 83W, and 93W fixed to the rotating shaft 13 rotate concurrently by an angle of rotation equal to that of the spur gear 12. Since the worms 73W, 83W, and 93W are in meshing engagement with the gears 72G, 82G, and 92G provided on the liquid containers 7, 8, and 9, respectively, the gears 72G, 82G, and 92G rotate in accordance with the number of rotations of the worms 73W, 83W, and 93W. Consequently, each of the liquid containers 7, 8, and 9 is rotated around an axis along the direction of the cylindrical axis of the liquid container 7, 8, 9 by a predetermined angle of rotation.

In the present embodiment of the invention, the liquid contained in each of the liquid containers 7, 8, and 9 includes pigment particles as its solute. The pigment particles of the liquid contained in the liquid container 8 have a greater tendency to precipitate than those of the liquid contained in the liquid containers 7 and 9. In view of the above, in the present embodiment of the invention, the gear pitch P2 of the worm 83W and the gear 82G is larger (coarser) than the gear pitch P1 of the worm 73W, 93W and the gear 72G, 92G. Because of the larger gear pitch, the angle of rotation (the number of rotations) R2 of the liquid container 8 is larger than the angle of rotation (the number of rotations) R1 of the liquid containers 7 and 9. Consequently, the liquid contained in the liquid container 8 is stirred with a greater degree of agitation as compared with the liquid contained in the liquid containers 7 and 9.

As described earlier, the container table 5 is moved in such a way as to approach the supply needles 21, 22, and 23 (relative displacement). As a result, the supply needles 21, 22, and 23 are respectively inserted into the liquid containers 7, 8, and 9 placed on the container table 5. In such a need-inserted state, the liquid supplying apparatus 10 according to the present embodiment of the invention is configured to supply the liquid contained in the liquid containers 7, 8, and 9 to the liquid ejecting mechanism 2. During the movement of the container table 5, the second rotation mechanism 32 explained above rotates each of the liquid containers 7, 8, and 9 by a predetermined number of rotations. The series of operations is explained below with reference to FIG. 6.

Figure 6A:
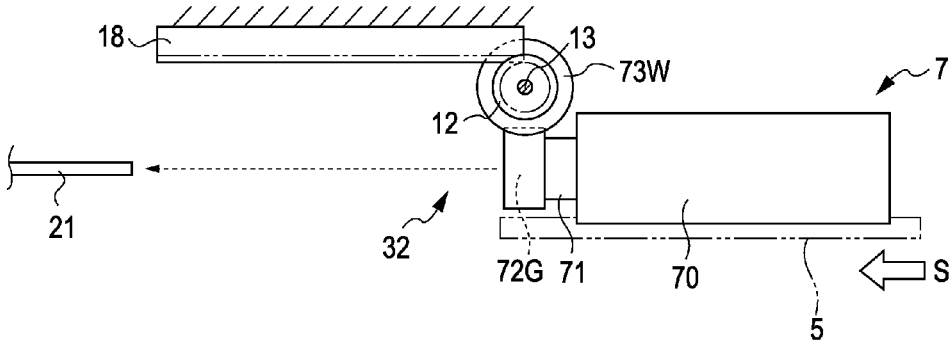
FIG. 6A is a diagram that schematically illustrates an example of a process of the insertion of a supply needle into a liquid container in the second embodiment of the invention.
Figure 6B:
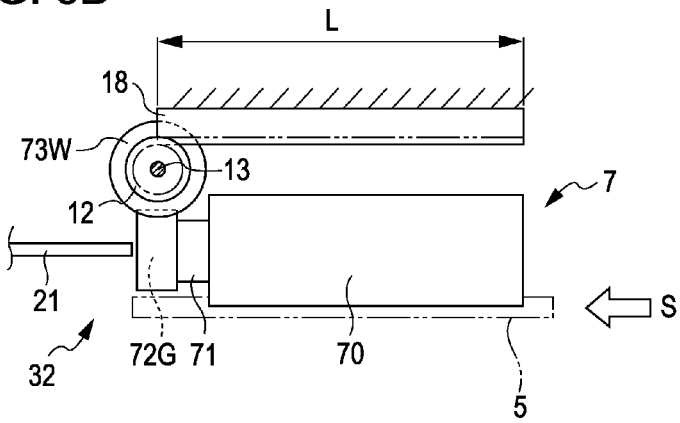
FIG. 6B is a diagram that schematically illustrates an example of a process of the insertion of the supply needle into the liquid container in the second embodiment of the invention.
Figure 6C:
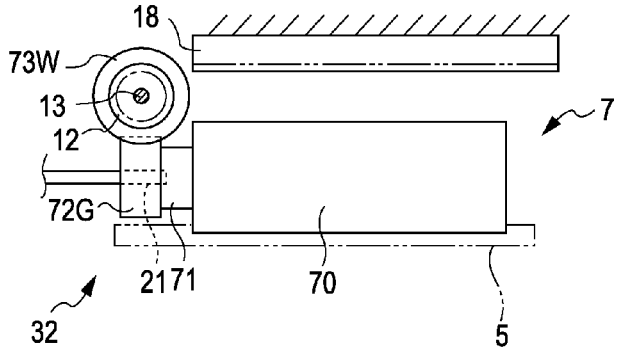
FIG. 6C is a diagram that schematically illustrates an example of a process of the insertion of the supply needle into the liquid container in the second embodiment of the invention.

FIG. 6 is a set of diagrams that schematically illustrates an example of the process of insertion of the supply needles 21, 22, and 23 into the liquid containers 7, 8, and 9, respectively. FIG. 6A schematically illustrates a state in which the meshing engagement of the spur gear 12 with the linear gear 18 starts. FIG. 6B schematically illustrates a state in which the meshing engagement of the spur gear 12 with the linear gear 18 ends, which means that they have now become disengaged from each other. FIG. 6C schematically illustrates a state in which the insertion of the supply needle 21 into the liquid container 7 has now been completed. In FIG. 6, the movement and rotation of the liquid container 7 is shown by way of illustration. It goes without saying that the movement and rotation of the liquid containers 8 and 9 is performed in the same manner as in the illustrated example.

The liquid supplying apparatus 10 according to the present embodiment of the invention operates as follows. As a first step, as illustrated in FIG. 6A, the meshing engagement of the spur gear 12 with the linear gear 18 starts either at a point in time when the movement of the container table 5 toward the supply needle 21 in the S direction starts or in the process of the movement of the container table 5 toward the supply needle 21 in the S direction. Since the worm 73W has not started to rotate yet before the meshing engagement of the spur gear 12 with the linear gear 18, the gear 72G, which is in meshing engagement with the worm 73W, has also not started to rotate yet. Therefore, the liquid container 7 has not started to rotate yet at this point in time.

As the container table 5 is moved in the S direction, the rotation of the spur gear 12 continues until it becomes disengaged from the linear gear 18 as illustrated in FIG. 6B, that is, throughout a movement distance corresponding to the length L of the linear gear 18 in the S direction. The number of rotations RT of the spur gear 12 during the meshing engagement with the linear gear 18 is determined as a value calculated by dividing the number of the teeth of the linear gear 18 throughout the length L by the number of the teeth of the spur gear 12. Since the worm 73W, which rotates concurrently with the spur gear 12, rotates the gear 72G, the liquid container 7 rotates by a predetermined number of rotations RS depending on the number of rotations RT of the spur gear 12.

The number of rotations RS of the liquid container 7 is determined as a value calculated by dividing a multiplication value of the number of rotations RT of the spur gear 12 and the gear pitch P1 of the worm 73W by the number of the teeth of the gear 72G. Therefore, it follows that the number of rotations RS of the liquid container 7 of the liquid supplying apparatus 10 is determined on the basis of the number of the teeth of the linear gear 18, the number of the teeth of the spur gear 12, the gear pitch P1 of the worm 73W, and the number of the teeth of the gear 72G.

As described earlier, in the present embodiment of the invention, the liquid contained in the liquid container 8 has greater precipitation characteristics than the liquid contained in the liquid containers 7 and 9. For this reason, the number of the teeth of the gear 82G provided on the liquid container 8 is smaller than the number of the teeth of each of the gears 72G and 92G provided respectively on the liquid containers 7 and 9. Therefore, the gear pitch P2 of the worm 83W, which is in meshing engagement with the gear 82G, is larger than the gear pitch P1 of the worm 73W, 93W. As the worm 83W rotates, the gear 82G rotates by a relatively large number of rotations. As a method to increase the number of rotations of the gear 82G, the outside diameter of the gear 82G may be made smaller. With such a structure, since the number of the teeth of the gear is reduced, the number of rotations of the gear 82G relative to the number of rotations of the worm 83W increases. When such a structure is adopted, the outside diameter of the worm 73W, which is in meshing engagement with the gear 82G, relative to that of the gear 82G increases.

In the present embodiment of the invention, as illustrated in FIG. 6C, after the completion of the rotation of the liquid container 7 due to the disengagement of the spur gear 12 from the linear gear 18, the container table 5 is moved farther in the S direction, resulting in the insertion of the supply needle 21 into the liquid container 7. In such a need-inserted state, the liquid contained in the liquid container 7 is supplied to the liquid ejecting mechanism 2. As described above, it is ensured that the liquid container 7 does not rotate during a period of time from the start of the insertion of the supply needle 21 into the liquid container 7 to the end of the insertion of the supply needle 21 into the liquid container 7.

In addition to the advantageous effects (1), (2), (5), (6), and (7) of the foregoing first embodiment of the invention, the second embodiment of the invention explained above can produce the following advantageous effects.

(8) When the container table 5 is moved toward the supply needles 21, 22, and 23 to cause relative displacement in a state in which the spur gear 12, which is a component of the second rotation mechanism 32, is in meshing engagement with the linear gear 18, which is another component of the second rotation mechanism 32, the driving-side gears rotate together with the spur gear 12. Since the driving-side gears rotate, the driven-side gears, which are respectively in meshing engagement with the driving-side gears, rotate. By this means, it is possible to rotate the liquid containers 7, 8, and 9 placed on the container table 5 with high reliability.

(9) As a pre-step before the insertion of the supply needle 21 into the liquid container 7, the rotation of the liquid container 7 is stopped due to the disengagement of the spur gear 12 from the linear gear 18 thereof. Therefore, at the time of the insertion of the supply needle 21 into the liquid container 7, the exertion of stress to the supply needle 21 or to the liquid container 7 in any direction other than the direction of insertion can be suppressed. The suppression of such undesirable stress improves liquid-tight reliability. For example, it has an effect of preventing the leakage of liquid from a contact region between the supply needle 21 and the liquid container 7.

(10) By setting the gear pitches of the worms 73W, 83W, and 93W and the gears 72G, 82G, and 92G, it is possible to adjust the degree of agitation (i.e., stirring) in the respective liquid containers 7, 8, and 9. Therefore, it is possible to make the stirred state of the liquid containers 7, 8, and 9 approximately equal by setting the gear pitches of the worms 73W, 83W, and 93W and the gears 72G, 82G, and 92G depending on the degree of precipitation of the solutes included in the liquid contained in the liquid containers 7, 8, and 9.

The foregoing exemplary embodiments of the invention may be modified as follows.

In the first embodiment of the invention, the cam portion 70C is formed as a concave. However, the scope of the invention is not limited to such an exemplary structure. For example, the cam portion 70C may be formed as a convex. When such a modified structure is adopted, the engagement portion 17 is formed as a concave for engagement with the convex.

The material that is used for the driven-side gears 72, 82, and 92 may be different from the material that is used for the bottleneck portions 71, 81, and 91 (and the body portions 70, 80, and 90). For example, the driven-side gears 72, 82, and 92 may be made of a metal material, whereas the bottleneck portions 71, 81, and 91 may be made of a resin material. When different materials are used, it is preferable to manufacture the driven-side gear 72, 82, 92 and the liquid container 7, 8, 9 as components separated from each other.

In the first embodiment of the invention, the second rotation mechanism 32 rotates the liquid containers 7, 8, and 9 in the direction opposite to the direction of the rotation thereof by the first rotation mechanism 31. However, the scope of the invention is not limited to such an exemplary structure. The second rotation mechanism 32 may rotate the liquid containers 7, 8, and 9 in the direction that is the same as the direction of the rotation thereof by the first rotation mechanism 31. With such a structure, when stirring liquid by means of the first rotation mechanism 31 only is not enough, it is possible to further rotate the liquid containers 7, 8, and 9 by means of the second rotation mechanism 32 in the same direction, thereby stirring the liquid well.

In the second embodiment of the invention, the driving-side gears and the driven-side gears of the second rotation mechanism 32 may be helical gears. As is generally known, a helical gear can transmit the power of rotation from the driving side to the driven side in the second rotation mechanism 32 as can be done by a worm gear.

Though detailed explanation is not given here, the driving-side gear may be made up of a plurality of gears for meshing engagement with the driven-side gear provided on the liquid container 7, 8, 9. Since the plurality of gears is used in such a structure, it is possible to transmit the power of rotation and release power transmission easily in the first rotation mechanism 31 or the second rotation mechanism 32.

In the second embodiment of the invention, the spur gear 12 may be rotated before the start of the meshing engagement thereof with the linear gear 18 as in the first rotation mechanism 31 according to the first embodiment of the invention. For example, a linear gear that has a row of teeth arranged in the D direction may be disposed at a position opposite to the supply needles 21, 22, and 23 in the S direction in such a manner that it can be brought into meshing engagement with the spur gear 12. With such a structure, it is possible to rotate the spur gear 12 before the start of the meshing engagement thereof with the linear gear 18 by moving the linear gear in the D direction. Alternatively, needless to say, the container table 5 may be moved in the D direction to rotate the spur gear 12 instead of moving such a D-directional linear gear.

In the first and second embodiments of the invention, the number of the supply needles 21, 22, and 23 is three. The number of the liquid containers 7, 8, and 9 is also three. However, the scope of the invention is not limited to such an exemplary structure. The number of the supply needles (the number of the liquid containers) may be one, two, four, or any other arbitrary number.

Though it is explained in the first and second embodiments of the invention that the rotation of a liquid container is stopped during a period of time from the start of the insertion of a supply needle into the liquid container to the end of the insertion of the supply needle into the liquid container, the rotation of the liquid container may be continued during the above period. The supply needle may be inserted into the liquid container while the liquid container is being rotated in a case where, for example, the degree of bending at the time of the insertion of the supply needle into the liquid container is small enough or in a case where the sealing region of the liquid container into which the supply needle is to be inserted is mechanically strong enough, and in addition thereto, the liquid-tight contact property of the sealing region with the supply needle inserted therethrough is good enough and, therefore, the risk of the leakage of the liquid therethrough is small. Since the number of rotations of the liquid container increases because of the insertion of the supply needle into the liquid container while the liquid container is being rotated, it is possible to stir the liquid contained in the liquid container well.

Though it is explained in the first and second embodiments of the invention that the movable container table 5 is moved toward the fixed supply needles 21, 22, and 23 to cause relative displacement, the supply needles 21, 22, and 23 may be moved toward the liquid containers 7, 8, and 9 placed on the container table 5 to cause relative displacement.

In the first and second embodiments of the invention, a liquid container having a cylindrical shape is rotated around one axis along the direction of the cylindrical axis thereof. However, the scope of the invention is not limited to such an exemplary structure. The liquid container may be rotated around one axis that is different from an axis that goes in the direction of the cylindrical axis thereof. For example, if the direction of the cylindrical axis of the liquid container placed on the container table 5 is the direction of gravitational force, it is preferable to rotate the liquid container around one axis that is different from an axis that goes in the direction of the cylindrical axis thereof, most preferably, around an axis that goes in the direction orthogonal to the direction of the cylindrical axis.

In the first and second embodiments of the invention, it is not always necessary to rotate all of a plurality of liquid containers (three liquid containers in the foregoing embodiments) placed on a container table in the same direction. With such a modified structure, angular moment that arises due to the rotation of the liquid containers on a container table can be suppressed as compared with angular moment that arises when all of the liquid containers are rotated in the same direction. It is expected that the suppression of the rotation moment will stabilize the movement of the container table.

Though the description of the foregoing embodiments of the invention is focused mainly on a liquid supplying apparatus, as understood from the foregoing description, the concept of the present invention may be applied to a liquid ejecting apparatus as an aspect thereof. As another aspect thereof, the invention may be applied to a liquid supplying method.

The entire disclosure of Japanese Patent Application No. 2009-284555, filed Dec. 15, 2009 is expressly incorporated by reference herein.

What is claimed is:

1. A liquid supplying apparatus comprising:

a liquid container containing liquid;

a table on which the liquid container is placed;

a needle that can be inserted into the liquid container so as to supply the liquid contained in the liquid container to a liquid consumption side therethrough, the liquid consumption side being a side at which the liquid supplied through the needle is consumed; and a rotation mechanism that rotates the liquid container around one axis being orthogonal to a direction of the gravitational force, in process of the relative movement which is the movement of the table with respect to the needle.

2. The liquid supplying apparatus according to claim 1, wherein the rotation mechanism rotates the liquid container around the one axis at least once during a period of time from the placement of the liquid container on the table to the insertion of the needle into the liquid container.

3. The liquid supplying apparatus according to claim 1, wherein the liquid container includes a plurality of liquid containers placed on the table; at least one of the plurality of liquid containers contains a second liquid that has greater precipitation property than that of a first liquid; and the rotation mechanism rotates each of the plurality of liquid containers in such a manner that the number of rotations of the at least one liquid container containing the second liquid is larger than the number of rotations of the others, the other, others, or another liquid container containing the first liquid.

4. The liquid supplying apparatus according to claim 1, wherein the liquid container has a cylindrical shape; and the one axis is an axis along the direction of the cylindrical axis of the liquid container.

5. The liquid supplying apparatus according to claim 1, wherein the rotation mechanism includes an engagement portion that can move relative to the liquid container placed on the table in a direction along the one axis; the engagement portion is in engagement with a cam portion in the process of the movement thereof relative to the liquid container; the cam portion is formed in or on an outer surface of the liquid container; and the cam portion has a spiral shape around the one axis.

6. The liquid supplying apparatus according to claim 5, wherein the rotation mechanism stops the rotation of the liquid container due to disengagement of the engagement portion from the cam portion of the liquid container before the insertion of the needle into the liquid container.

7. The liquid supplying apparatus according to claim 1, wherein the rotation mechanism includes a linear gear that extends in the direction of the relative movement of the table and the needle, a spur gear that is in meshing engagement with the linear gear in the process of the relative movement of the table and the needle, and a driving gear that is interlocked with the spur gear by a rotating shaft and is provided over the table in such a manner that the driving gear can be in meshing engagement with a driven gear provided on the liquid container; and the driven gear rotates around the one axis.

8. The liquid supplying apparatus according to claim 7, wherein the rotation mechanism stops the rotation of the liquid container due to disengagement of the spur gear from the linear gear before the insertion of the needle into the liquid container.

9. A liquid ejecting apparatus comprising:

a liquid ejecting head that consumes liquid when performing liquid ejecting operation, and the liquid supplying apparatus according to claim 1.

10. A liquid supplying method comprising:

moving, for relative movement, a table with respect to a needle, the needle with respect to the table, or both the table and the needle with respect to each other, a liquid container that contains liquid being placed on the table, the needle being able to be inserted into the liquid container so as to supply the liquid contained in the liquid container to a liquid consumption side therethrough, the liquid consumption side being a side at which the liquid supplied through the needle is consumed, and rotating the liquid container around one axis being orthogonal to a direction of the gravitational force, in the process of the relative movement by bringing a rotation mechanism into engagement with the liquid container.

* * * * *